US007281956B1

(12) United States Patent
Ju

(10) Patent No.: US 7,281,956 B1
(45) Date of Patent: Oct. 16, 2007

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/580,084

(22) Filed: Oct. 13, 2006

(51) Int. Cl.
*H01R 24/04* (2006.01)

(52) U.S. Cl. ..... 439/669

(58) Field of Classification Search ..... 439/541.5, 439/593, 669, 839, 592
See application file for complete search history.

(56) References Cited

U.S. PATENT DOCUMENTS 4,534,610 A * 8/1985 Takihara ..... 439/712
6,062,885 A * 5/2000 White ..... 439/188

* cited by examiner

*Primary Examiner*—Phuong Dinh
(74) *Attorney, Agent, or Firm*—Rosenberg, Klein & Lee

(57) ABSTRACT

The present invention relates to an electrical connector, which includes jacks for accommodating external electronic devices. A plurality of terminals and an extruding arm for extruding the external electronic device, which extruding arm is an insulator and moves elastically, are adapted in the jacks. Thereby, the holding ability is increased and hence the conducting effect is enhanced.

15 Claims, 6 Drawing Sheets

ELECTRICAL CONNECTOR

FIELD OF THE INVENTION

The present invention related to a connector, and particularly to an electrical connector applied in audio jacks.

BACKGROUND OF THE INVENTION

With technological development in various electronic products and multimedia personal computers, the applications of audio jack connectors prevail in the industries described above increasingly. In addition, different kinds of electronic products expand their peripheral equipments, and thereby the demand in performance of audio jack connectors increases as well.

An audio jack connector is disclosed in U.S. Pat. No. 6,062,885, wherein the electrical switching device includes a first switching terminal and a second switching terminal. A body is adapted to the first switching terminal, which is suspended on an elastic terminal arm adapted on the back of the body. In normal conditions, that is, when there is no butting plug inserted, the second switching terminal contacts with the elastic terminal arm of the first switching terminal. When the elastic terminal arm moves towards the body, the contact with the second switching terminal is broken. Thereby, the switching function is realized. However, there is no element to hold the terminal while butting, the holding ability is low and unstable. Consequently, the electrical conductivity is poor.

Accordingly, it is necessary to design a new electrical connector for overcoming the problems described above.

SUMMARY

The purpose of the present invention is to provide an electrical connector, which holds butting plug therein effectively.

In order to achieve the purpose described above, the electrical connector according to the present invention includes jacks for accommodating external electronic devices. A plurality of terminals and an extruding arm for extruding the external electronic device, which extruding arm is an insulator and moves elastically, are adapted in the jacks.

In comparison with current technologies, the novel electrical connector according to the present invention can increase holding ability and the conducting effect is enhanced, accordingly.

DETAILED DESCRIPTION

Figure 1:
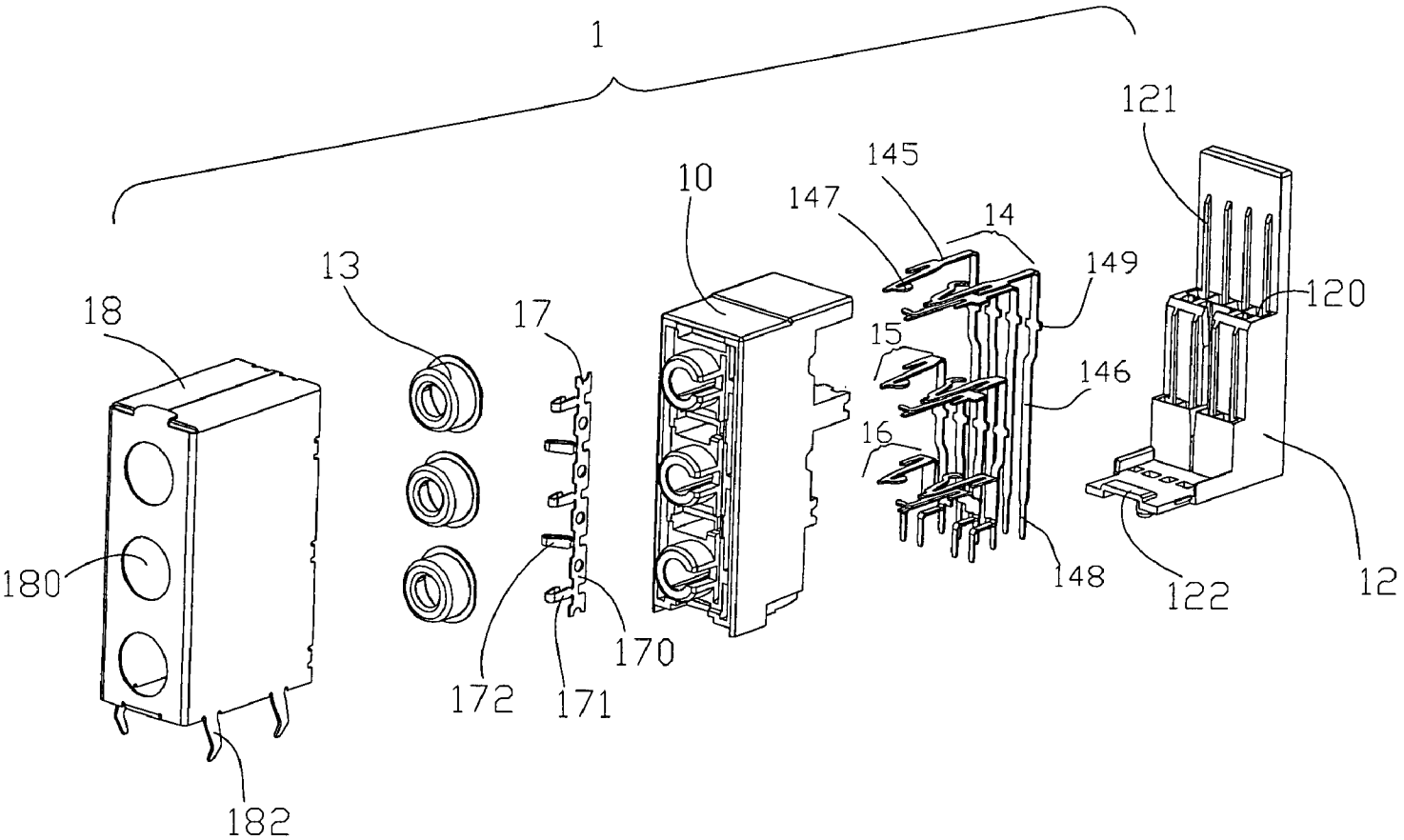
FIG. 1 is an exploded view of an electrical connector according to an embodiment of the present invention.
Figure 2:
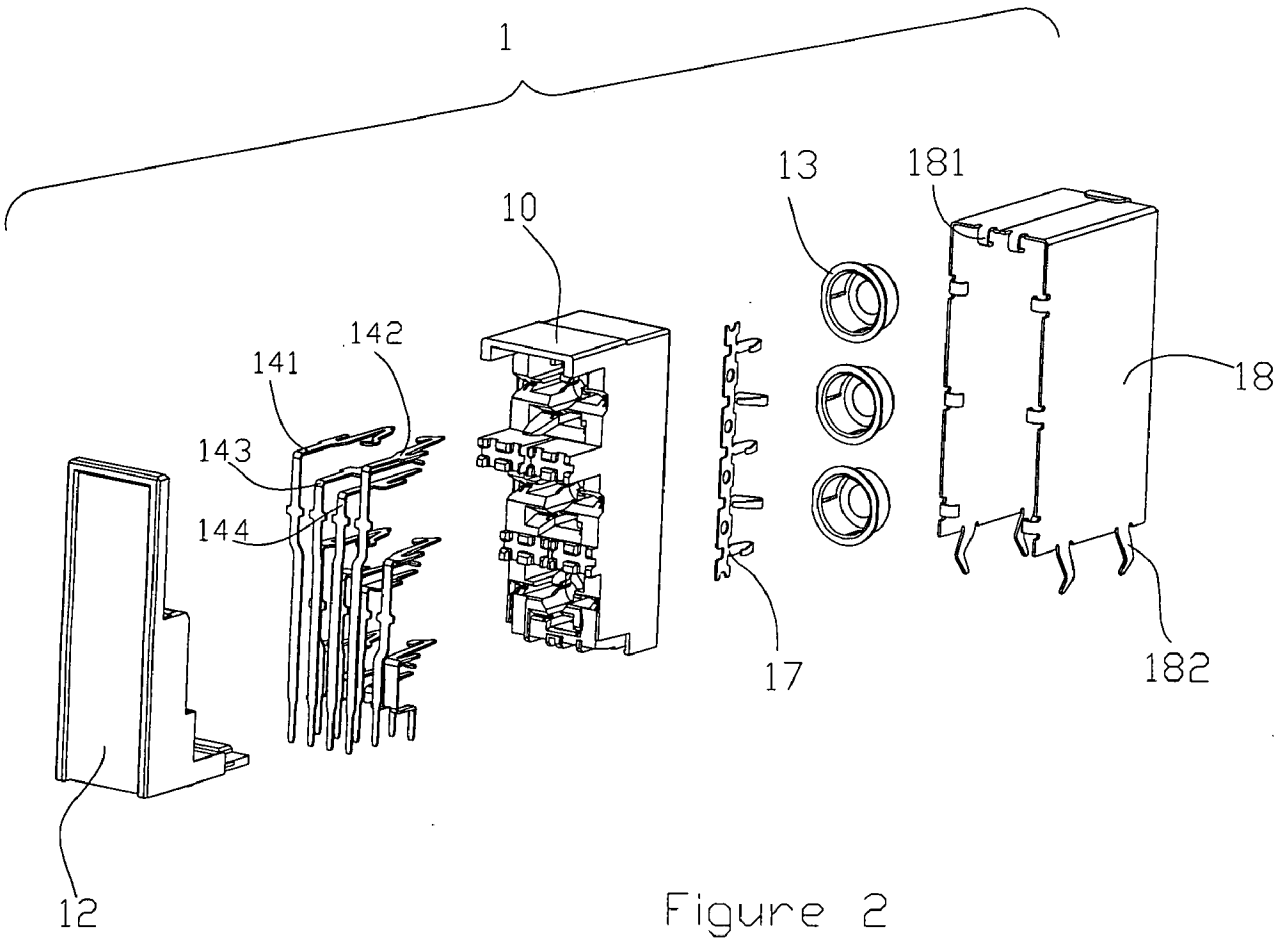
FIG. 2 is another view of the electrical connector according to an embodiment of the present invention in FIG. 1.
Figure 4:
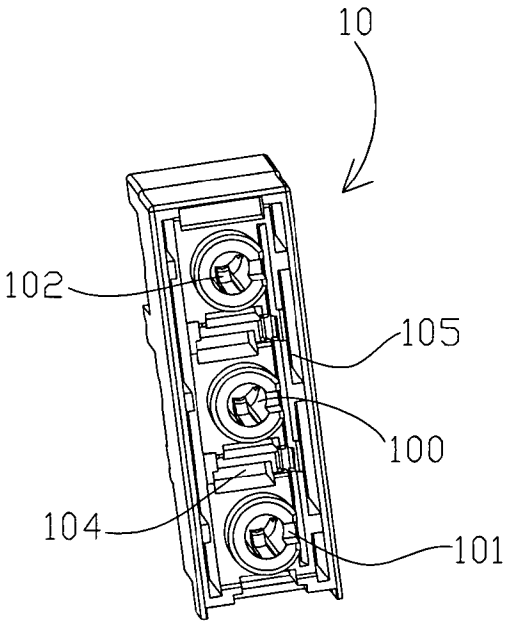
FIG. 4 is an external view of the insulation body of the electrical connector according to an embodiment of the present invention in FIG. 1.
Figure 3:
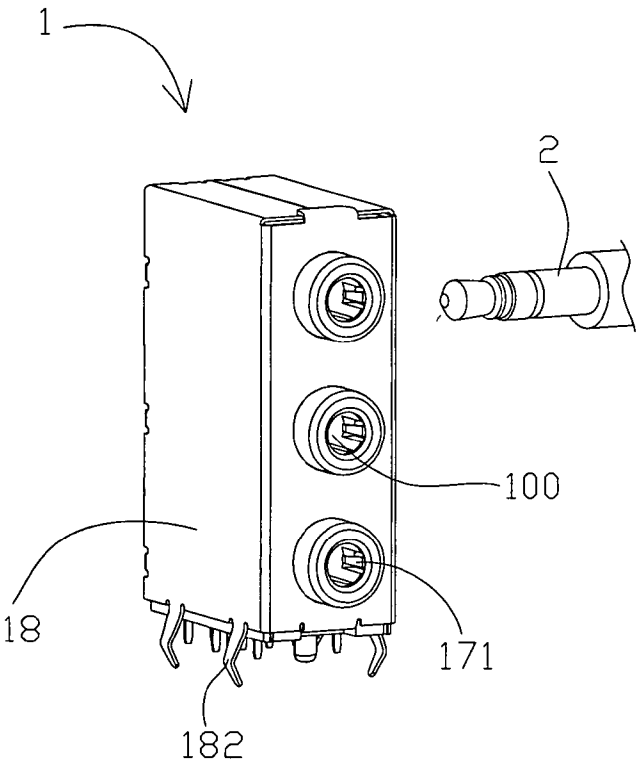
FIG. 3 is an external view of the electrical connector according to an embodiment of the present invention in FIG. 1.
Figure 6:
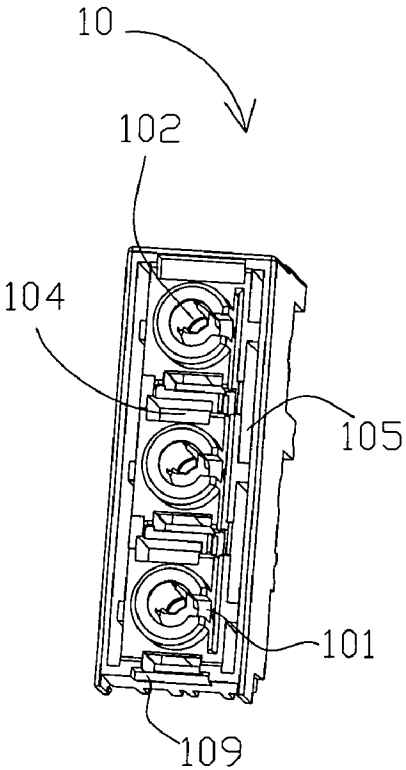
FIG. 6 is another external view of the insulation body of the electrical connector according to an embodiment of the present invention in FIG. 4.
Figure 5:
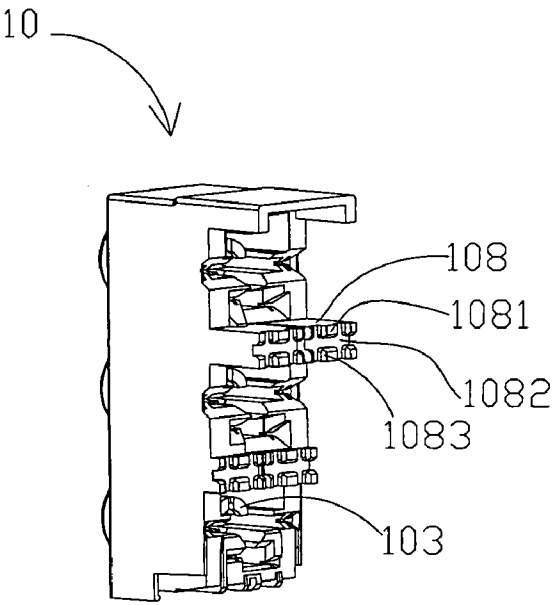
FIG. 5 is another external view of the insulation body of the electrical connector according to an embodiment of the present invention in FIG. 4.
Figure 8:
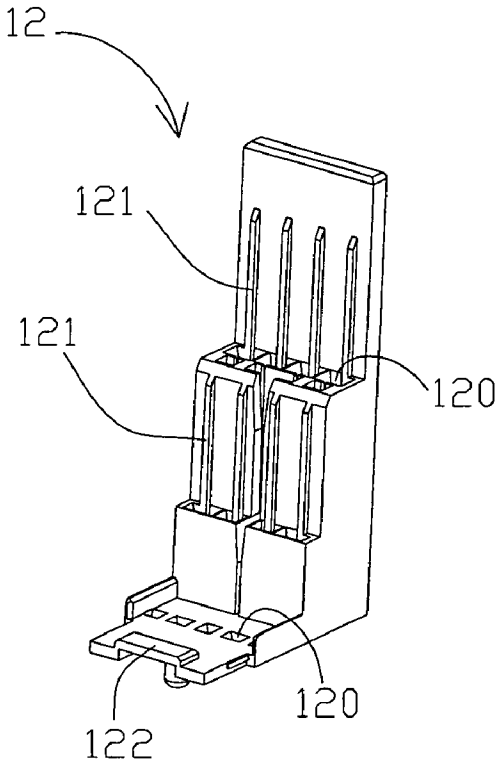
FIG. 8 is an external view of the back base of the electrical connector according to an embodiment of the present invention in FIG. 1.

In order to make the structure and characteristics as well as the effectiveness of the present invention to be further understood and recognized, the detailed description of the present invention is provided as follows along with preferred embodiments and accompanying figures.

As shown in FIGS. 1 to 8, an electrical connector 1 according to the present invention is an audio jack connector, which connects with an external electronic device (a plug 2) for realizing transmission of audio signals. The electrical connector 1 includes an insulation body 10, a back base 12, a plurality of rings 13, three sets of terminal sets 14, 15, 16 arranged in a line (upper, middle, and lower) with four terminals in each of the terminal sets, a grounding electrode 17 with a plurality of grounding terminals thereon, and a sheltering housing 18 covering the insulation body 10 and the back base 12.

Figure 7:
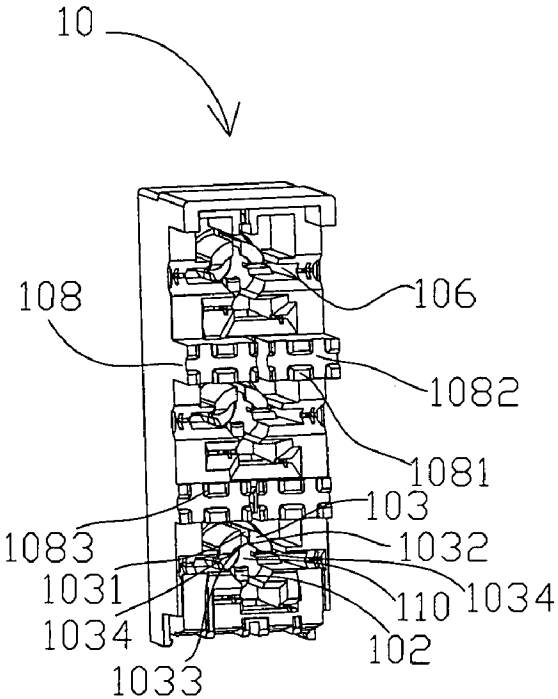
FIG. 7 is another external view of the insulation body of the electrical connector according to an embodiment of the present invention in FIG. 4.
Figure 11:
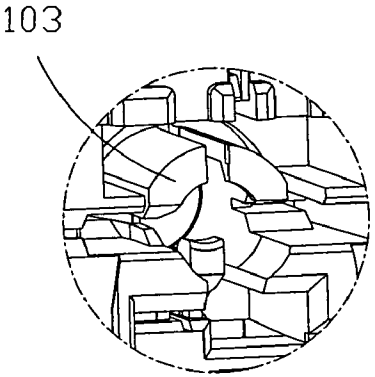
FIG. 11 is an enlarged view of a portion of FIG. 7.
Figure 10:
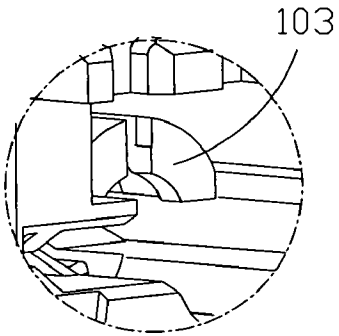
FIG. 10 is an enlarged view of a portion of FIG. 5.
Figure 9:
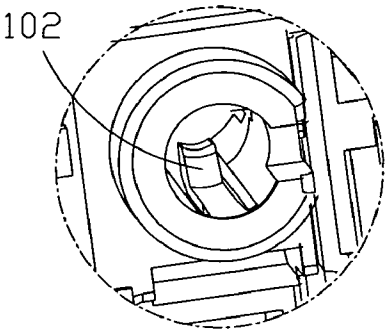
FIG. 9 is an enlarged view of portion of FIG. 4.

Jacks 100 are adapted on the insulation body 10 for butting with the plug 2 and are arranged in a line (upper, middle, and lower). A terminal set is adapted in each of the jacks 100, Each terminal set includes four terminals comprising a first and a second terminal 141, 142 connecting with the plug 2, and a third and a fourth terminal 143, 144 conducting with each other. Each terminal includes a horizontal part 145 and a vertical part 146 perpendicular to each other. A contact part 146 is adapted on the horizontal part 145, while a conducting part 148 is adapted on the bottom end of the vertical part 146. A breach 101 is adapted on the side edge of each of the jacks 100, respectively. A moving arm 102 is adapted at bottom of inner side of each of the jacks 100, and is formed integrally with the insulation body 10. The moving arm 102 can compress the third terminal 143 to touch the fourth terminal 144 (Alternatively, a conductor can be adapted additionally in the jack. The moving arm 102 compresses the conductor, which, in turn, touches the third terminal 143 and the fourth terminal 144). An extruding arm 103 is adapted on top of inner side of each of the jacks 100, and is formed integrally with the insulation body 10. The extruding arm 103 can move elastically for increasing holding ability and for enhancing ease of forming. A body part 1031, a protruding part 1032, and a dragging part 1033 are adapted on the extruding arm 103. The back end of the body part 1031 is larger than the front end thereof. The protruding part 1032 can exert pressure upon the external electronic devices, and is adapted inside the jacks 100. The dragging part 1033 can guide the external electronic devices. A space is formed between the extruding arm 103 and the sidewall of the jack 100. The extruding arm 103 has two contact points 1034. Together with the sidewall of the jack 100, they form three points for extruding the external electronic devices. Two recessed notches 104 are adapted between the jacks 100 on the front side of the insulation body 10, that is, the spacing in the vertical direction. A grounding-electrode accommodating groove 105 is adapted near the jack 100 on the front side of the insulation body 10 for accommodating the grounding electrodes 17. Three terminal accommodating grooves 106 are adapted in a line (upper, middle, and lower) on the backside of the insulation body 10, and each terminal set is accommodated in the corresponding terminal accommodating groove 106. On the backside of the insulation body 10, mounting pedestals 108 are adapted between two adjacent jacks. Positioning structures are adapted on the mounting pedestals 108 for positioning the vertical parts of the upper and the middle terminals. The vertical parts of the lower terminals are shorter and thereby the problem of greater swing when force are exerted. Hence, the mounting pedestals for positioning the lower terminals are not needed. The positioning structure includes a plurality of salients 1081 and a hollow portion 1082. A protruding portion 149 is adapted on the terminals to match up the hollow portion 1082. (Of course, the vertical part of the terminals can have no protruding portion 149. Instead, depression portions can be adapted to match up the plurality of salients 1081, as shown in FIG. 7.) A guiding portion 1083 is adapted on the plurality of salients 1081 for guiding the terminals to the hollow portion 1082. A groove 109 is adapted at the bottom of the insulation body 10. Between two adjacent jacks of the insulation body 10, the protruding mounting pedestals with positioning structures are adapted for positioning the terminals, which can match up the back base 12 to fix the terminals in the electrical connector effectively for ensuring the stability of the electrical connector.

The back base 12 is arranged in ladders. A plurality of openings 120 is adapted on each ladder for accommodating the conducting part of the terminals. At the positions corresponding to the hollow portions 1082, a plurality of protruding strips 121 are adapted to match up the hollow portions 1082 for fix firmly the vertical parts of the terminals between the insulation body 10 and the back base 12. At the front side of the bottom of the back base 12, a wedge 122 is adapted for clipping into the groove 109 at the bottom of the insulation body 10.

The grounding electrode 17 includes a body portion 170, a first grounding terminal 171 extended from the body portion 170 and then bent, and a second grounding terminal 172 bent from the body portion 170, extended, and then bent again.

The sheltering housing 18 is formed integrally by stamping metal plates. A plurality of penetrating bores 180 corresponding to the jacks 100 on the insulation body 100 is adapted on the front side thereof. A plurality of hook parts 181 is formed and is bent inwards at the backside thereof for holding the insulation body 10 and the back base 12 in the sheltering housing 18 securely. A plurality of grounding pins 182 is adapted on both sides of the bottom of the sheltering housing 18.

When assembling, install firstly the upper, the middle, and the lower terminals to the corresponding terminal accommodating grooves 106 in the three jacks 100 from the backside of the insulation body 10. The body portion 170 of the grounding electrode 17 is installed in the grounding-electrode accommodating groove 105. Part of the first grounding terminal 171 is installed in the breach 101, and the other part thereof extends into the jack 100. Part of the second grounding terminal 172 is installed in the notches 104, and the other part thereof protrudes outside the notches 104. Then, install the plurality of rings outside the jacks 100. Next, use the back base 12 to match up the insulation body 10 to fix the vertical parts of the terminals. At last, cover the sheltering housing 18. The plurality of hook parts 181 clips on the backside of the back base 12 to hold securely the insulation body 10 and the back base 12 in the sheltering housing 18. The electrical connector 1 according to the present invention is thereby formed. When the plug 2 is inserted into the jack 100, the extruding arm 103 extrudes the plug 2 and exerts pressure on it. At this time, the plug 2 is against the moving arm 102 and thereby increasing the holding ability for the plug 2. Meanwhile, the moving arm 102 presses and connects to the third terminal 143 to make it connect with the fourth terminal 144. The first grounding terminal 171 connects with the plug 2. The second grounding terminal 172 connects with the frond side of the sheltering housing 18. Consequently, the static electricity between the sheltering housing 18 and the plug 2 can be conducted to the negative electrode of the circuit board (not shown in the figures) by way of the grounding pins 182 of the sheltering housing 18. Thereby, the static electricity is expelled.

Accordingly, the present invention conforms to the legal requirements owing to its novelty, unobviousness, and utility. However, the foregoing description is only a preferred embodiment of the present invention, not used to limit the scope and range of the present invention. Those equivalent changes or modifications made according to the shape, structure, feature, or spirit described in the claims of the present invention are included in the appended claims of the present invention.

The invention claimed is:

1. An electrical connector, comprising:

an insulation body, a jack being formed on a front inner surface of said insulation body and extending outwardly therefrom, said jack receiving an external electronic device, a moving arm being formed on a lower inner surface of said jack an extruding arm being formed on an upper inner surface of said jack; and a plurality of terminals, selectively inserted in a respective terminal accommodating groove formed on a backside of the insulation body, said terminals including first and second terminals wherein each of said first and second terminal electrically contacts with said external electronic device when said external electronic device is received in said jack and third and fourth terminals electrically contacting each other.

2. The electrical connector of claim 1, wherein the moving arm abuts against the third and fourth terminals when said external electronic device is inserted in said jack thereby electrically connecting the third and fourth terminals together.

3. The electrical connector of claim 1, wherein a conductor is further installed in the jack, whereby the moving arm abuts against the conductor thereby electrically connecting the third terminal and the fourth terminals together.

4. The electrical connector of claim 1, wherein the extruding arm and a sidewall of the jack form a space for accommodating the external electronic device.

5. The electrical connector of claim 4, wherein the extruding arm has two contact points, forming three points along with the sidewall of the jack for extruding the external electronic device.

6. The electrical connector of claim 1, wherein the extruding arm only contacts with said external electronic device.

7. The electrical connector of claim 1, wherein the extruding arm includes a body part and a protruding part, thereby exerting pressure on the external electronic device, the protruding part being formed in a space of the jack.

8. The electrical connector of claim 7, wherein a guiding part is formed on the protruding part, and the back end of the body part being larger than the front end thereof.

9. The electrical connector of claim 1, wherein a mounting pedestal is formed on the insulating body on a side opposing the jack, said mounting pedestal further protruding outwardly.

10. The electrical connector of claim 9, wherein a plurality of positioning structures are formed on the mounting pedestal for positioning the terminals.

11. The electrical connector of claim 10, further including a back base to match up the electrical connector and the positioning structures for fixing the terminals in the positioning structures.

12. The electrical connector of claim 10, wherein the positioning structures include a plurality of salients and a plurality of hollow portions formed by the salients.

13. The electrical connector of claim 12, wherein a plurality of protruding portions is formed on the terminals for being matingly inserted in the hollow portions.

14. The electrical connector of claim 12, wherein a plurality of depression portions is formed on the terminals for matching up the salients, a plurality of guiding portions being formed on the salients for guiding the terminals into the depression portions.

15. The electrical connector of claim 1, wherein the extruding arm inhibits the conduction of electricity.

* * * * *